US006234097B1

(12) United States Patent
Ku

(10) Patent No.: US 6,234,097 B1
(45) Date of Patent: May 22, 2001

(54) THREAD CUTTING DEVICE FOR A SEWING MACHINE

(76) Inventor: Fei-Lung Ku, No. 10, Alley 6, Lane 148, Kai Yuan Road, Tainan (TW)

( * ) Notice: Subject to any disclaimer, the term of this patent is extended or adjusted under 35 U.S.C. 154(b) by 0 days.

(21) Appl. No.: 09/665,371

(22) Filed: Sep. 20, 2000

(51) Int. Cl.[7] ..... D05B 65/00
(52) U.S. Cl. ..... 112/298
(58) Field of Search ..... 112/298, 296, 112/297, 291, 292, 285, 288, 199, 286

(56) References Cited

U.S. PATENT DOCUMENTS 5,870,962 * 2/1999 Ku ..... 112/292
5,887,535 * 3/1999 Yu ..... 112/298

* cited by examiner

*Primary Examiner*—Peter Nerbun
(74) *Attorney, Agent, or Firm*—Rosenberg Klein & Lee

(57) ABSTRACT

A thread cutting device of a sewing machine has a fixed plate, first and a second adjustable arms, a cutting arm with a front end knife, a swing arm pivoted to the fixed plate and a hook arm with two hooks. The adjustable arms are relocatably fitted on the fixed plate. The cutting arm is pivoted to the first adjustable arm. The hook arm is movably fitted to the cutting arm with two long holes connecting a bolt of the cutting arm, and the second adjustable arm respectively, and has a gap receiving one end of the swing arm such that the hook arm is moved back and forth to hook and retreat threads for the knife to cut off when the swing arm is swung.

2 Claims, 11 Drawing Sheets

THREAD CUTTING DEVICE FOR A SEWING MACHINE

BACKGROUND OF THE INVENTION

The present invention relates to a thread cutting machine, and particularly to one which has a hook arm movable to hook and retreat threads for a cutting knife to cut off; the hook rod is fitted to a hook rod arm which can be adjusted in respect of position relative to a swing arm for adjusting the moving path of the hook rod.

Related prior arts of the thread cutting device for a sewing machine of the present invention include U.S. Pat. Nos. 4,098,209 and 2, 892,012; 5,481,994 was also devised by the inventor of the present invention, aimed at improving U.S. Pat. No. 4,098,209.

Referring to FIG. 10, a conventional thread cutting device of a sewing machine has fixed plate 61, a cutting knife arm 62, a securing member 63, a cutting knife 64, a hook rod arm 65, a hook rod 66 and a swing arm 67.

The fixed plate 61 has several fixing holes 611, and is fixed to the sewing machine by means of screws 6111 passed through the fixing holes 611. The fixed plate 61 further has a receiving recess 612 and screw holes 613, 6121.

The cutting knife arm 62 has a through hole 621, a guide slot 622, screw holes 623, 623 at an intermediate portion, and a screw hole 624 at a front end portion. The cutting knife arm 62 is pivoted to the fixed plate 61 by a screw 6212 and an axle cap 6211; the screw 6212 being passed through the through hole 621 and the a-de cap 6211, and connected to the screw hole 6121 on the receiving recess 612; the rear end portion of the cutting knife arm 62 being received in the receiving recess 612.

The cutting knife 64 is fixed to the front end portion of the cutting knife arm 64 with a screw 642 screwed into the screw hole 624; a pad 643 is disposed between the cutting knife 64 and the cutting knife arm 62.

The securing member 63 is also fixed to the front end portion of the cutting knife arm 62 by screws 632 with a fixing plate 633 connected to a bottom.

The hook rod arm 65 has a gap at a rear end portion, two elongated guide holes 652 and screw holes 653 at a front end portion. The hook rod arm 65 is movably connected to the cutting knife arm 62 by means of two screws 6522 each passed through an axle cap 6521, a respective one of the elongated guide holes 652, and screwed into a respective one of the screw holes 623 of the cutting knife arm 62.

The hook rod 66 is connected to the front end portion of the hook rod arm 65 by screws 662 screwed into the screw holes 653. The hook rod 66 has a front hook 663 at a front end, and a rear hook 664 behind the front hook 663.

The swing arm 67 has a pivotal hole 671, a through hole 674 and a head 673. The swing arm 67 is pivoted to the fixed plate 61 by means of a screw 6721 passed through an axle cap 672, the pivotal hole 671 and the screw hole 613 of the fixed plate 61 in sequence. The head 673 of the swing arm 67 is movably received in the gap 651 of the hook rod arm 65 such that the hook rod arm 65 can be moved back and forth relative to the cutting knife arm 62 when the swing arm 67 is swung. Moreover, a screw pin 6751 is connected to the through hole 674 of the swing arm 67 and nuts 676, 677 from two ends. The nut 677 is movably received in the guide slot 622 of the cutting knife arm 62.

In using the thread cutting device, referring to FIG. 11, firstly, the swing arm 67 is swung for the head 673 to move forwards with the nut 677 moving from the curved rear end position to a straight front portion; thus, the cutting knife arm 62 will be pivoted on the screw 6212 to a position substantially parallel to lateral sides of the fixed plate 61. Meanwhile, the hook rod arm 65 is also moved to the parallel position.

Secondly, referring to FIG. 12, the swing arm 67 is swung further forwards, forcing the hook rod arm 65 to move forwards relative to the cutting knife arm 62. Thus, hook rod 66 projects from the cutting knife 64, and hook threads from the hooks 663, 664. Then, the swing arm 67 is swung back to retreat the hook rod arm 65; thus, the threads are cut by the cutting knife 64 and the hooks 663, 664 when the hooks 663, 664 move past the cutting knife 64; the hook rod 66 abutting the cutting knife 64 for the threads to be cut easily because of the securing member 63.

However, the above thread cutting device of a sewing machine is found to have disadvantages as follows.

1. The arm of force A, i.e. the distance between the fulcrum screw 6212 and the nut 677, is much shorter than B, i.e. the distance between the nut 677 and the hook rod 66. Consequently, relatively much force has to be applied to swing the swing arm 67, resulting in waste of power.
2. Using the screw 6212 as a fulcrum, the front and the rear hooks 663, 664 of the hook rod 66 has relatively large range of oscillation, and cannot move very smoothly. Consequently, the service life of related parts can be shortened.
3. Using the screw 6212 as a fulcrum, the cutting knife arm 62 and other parts associated with it cannot be adjusted to an optimum position.

SUMMARY OF THE INVENTION

Therefore, it is a main object of the present invention to provide a thread cutting device of a sewing machine which can be operated with less power and more smoothly, and of which the parts can be adjusted to an optimum position.

The thread cutting device of a sewing machine of the present invention has a fixed plate, an adjustable arm member, a cutting knife arm with a front end cutting knife, a swing arm and a hook rod arm with two front end portion hooks.

The fixed plate is fixed to the sewing machine.

The adjustable arm member has a first and a second adjustable arms relocatably fitted on the fixed plate; the adjustable arm each having a connecting protrusion on an outer end.

The cutting knife arm is pivoted to the connecting protrusion of the first adjustable arm from a pivotal hole at a distance from the inner end.

The swing arm is pivoted to the fixed plate from an intermediate portion, and has a head at an end facing the knife arm.

The hook rod arm has a gap receiving the head of the swing arm, and a first and a second elongated holes receiving a bolt on the knife arm and the connecting protrusion of the second adjustable arm respectively for confining a moving path of the hook rod arm. The second elongated hole has a curved end portion at a front end.

The hook rod arm is moved back and froth by the swing arm when the swing arm is swung, hooking and retreating threads for the cutting knife to cut off.

The curved end portion of the second elongated hole permits the hook rod arm to be adjusted in respect of the direction when the curved end portion of the hook rod arm separates from the connecting protrusion.

Because the adjustable arms are relocatable, the cutting path of the thread cutting device can be adjusted.

BRIEF DESCRIPTION OF THE DRAWINGS

This invention will be better understood by referring to the accompanying drawings, wherein.

DESCRIPTION OF THE PREFERRED EMBODIMENT

Figure 1:
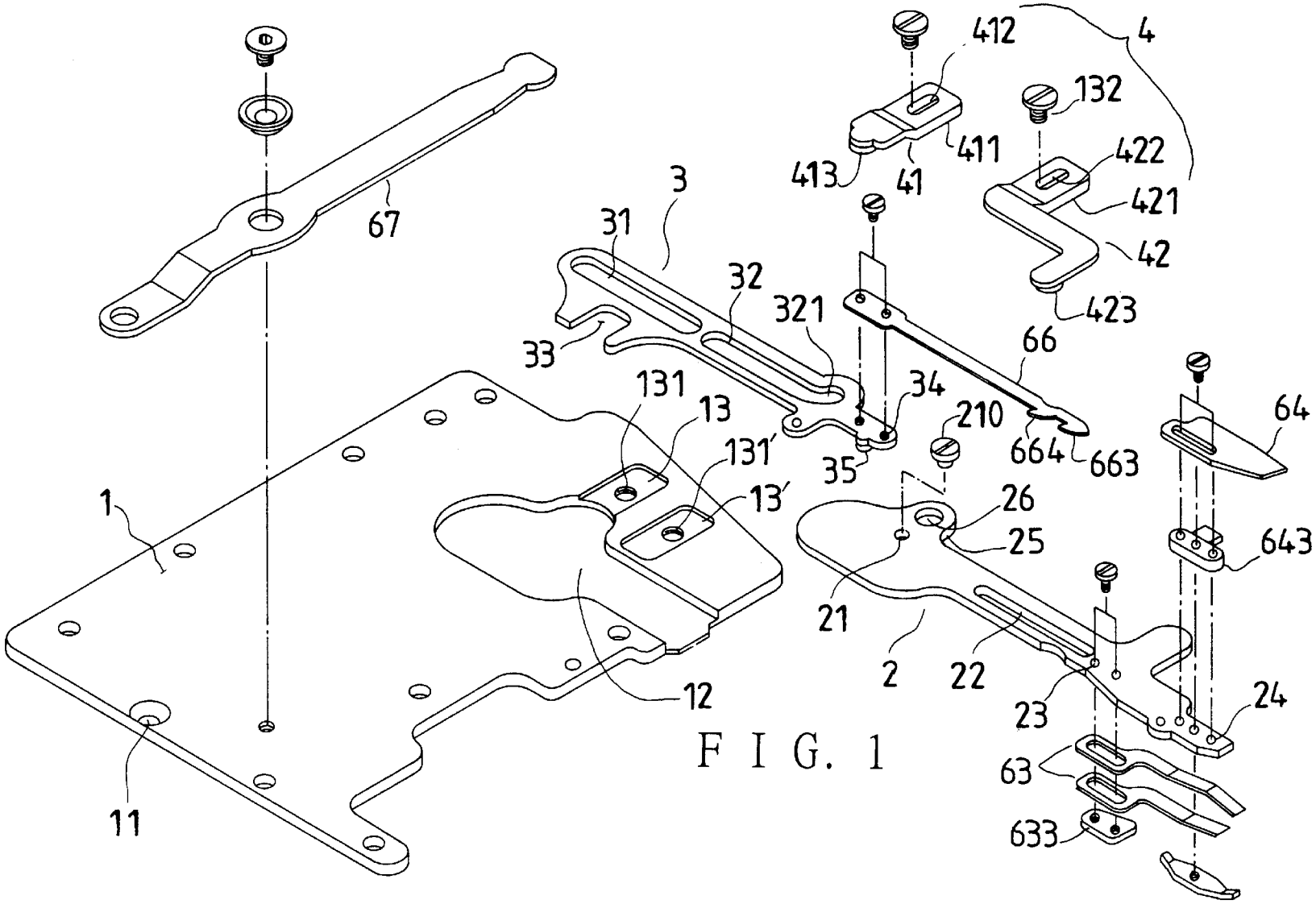
FIG. 1 is an exploded perspective view of the thread cutting device of a sewing machine of the present invention.
Figure 2:
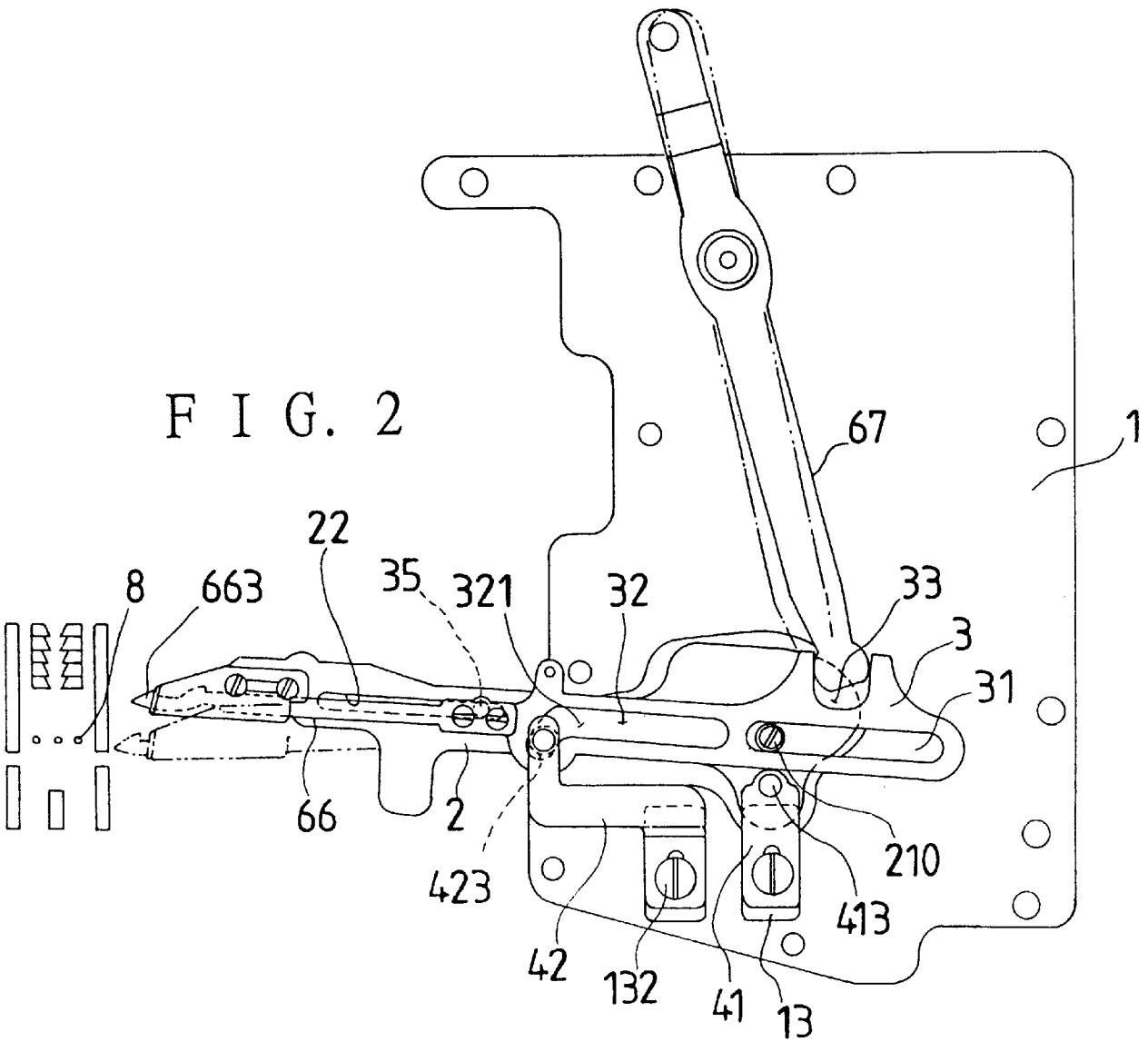
FIG. 2 is a top view of the thread cutting device of a sewing machine of the present invention.

Referring to FIGS. 1 and 2, a thread cutting device of a sewing machine of the present invention has a fixed plate 1, a cutting knife arm 2, a hook rod arm 3, an adjustable arm member 4, a securing member 63, a cutting knife 64, a hook rod 66 and a swing arm 67.

The fixed plate 1 is fixed to the sewing machine, and has a receiving recess 12, a first and a second holding recesses 13, 13' having a screw hole 131, 131' respectively.

The cutting knife arm 2 has a through hole 21, a side protrusion 25 formed a distance from the rear end, a lengthwise elongated hole 22 on an intermediate portion, holes 23 and screw holes 24 on a front end portion. A connecting bolt 210 is connected to the through hole 21. A through hole 26 is formed on the side protrusion 25.

The adjustable arm member 4 includes a first adjustable arm 41 and a second adjustable arm 42 having an inner end portion 411, 421 respectively; the inner end portion 411, 421 having a long hole 412, 422 respectively. The arms 41, 42 further have a connecting protrusion 413, 423 on an outer end respectively. The arms 41, 42 are connected to the holding recesses 13, 13' from inner end portions 411, 421 respectively by means of screws passed through the long hole 412, 422 and the screw holes 131, 131'. Thus, the first and the arms 41, 42 can be adjusted in respect of position relative to the holding recesses 13, 13'.

The cutting knife arm 2 is pivoted to the first adjustable arm 41 with the connecting protrusion 413 of the arm 41 passed into the through hole 26 of the cutting knife arm 2.

The securing member 63 and the cutting knife 64 is connected to the front end portion of the cutting knife arm 2 with screws in a way same as the conventional thread cutting device of the Background; a pad 643 is disposed between the cutting knife 64 and the cutting knife arm 2; a fixing plate 633 is used to fix the securing member 63 to the arm 2.

The hook rod arm 3 has a gap 33, a first and a second elongated holes 31, 32, holes 34 and a connecting protrusion 35 on a bottom of a front end portion; the second elongated hole 32 has a curved end portion 321 at a front end. The hook rod arm 3 is movably connected to the cutting knife arm 2, and the second adjustable arm 42 with the connecting bolt 210 of the cutting knife arm 2, and the connecting protrusion 423 of the second adjustable arm 42 received in the first and the second elongated holes 31, 32 respectively. Moreover, the connecting protrusion 35 is received in the lengthwise elongated hole 22 of the cutting knife arm 2. Thus, the hook rod arm 3 can move relative to the cutting knife arm 2.

The hook rod 66 is connected to the front end portion of the hook rod arm 3 by means of screws screwed into the holes 34 of the hook rod arm 3. The hook rod 66 has a front hook 663 at a front end and a rear hook 664 behind the front hook 663.

The swing arm 67 is pivoted to the fixed plate 1 from an intermediate portion, and has a head movably received in the gap 33 of the hook rod arm 3.

Figure 3:
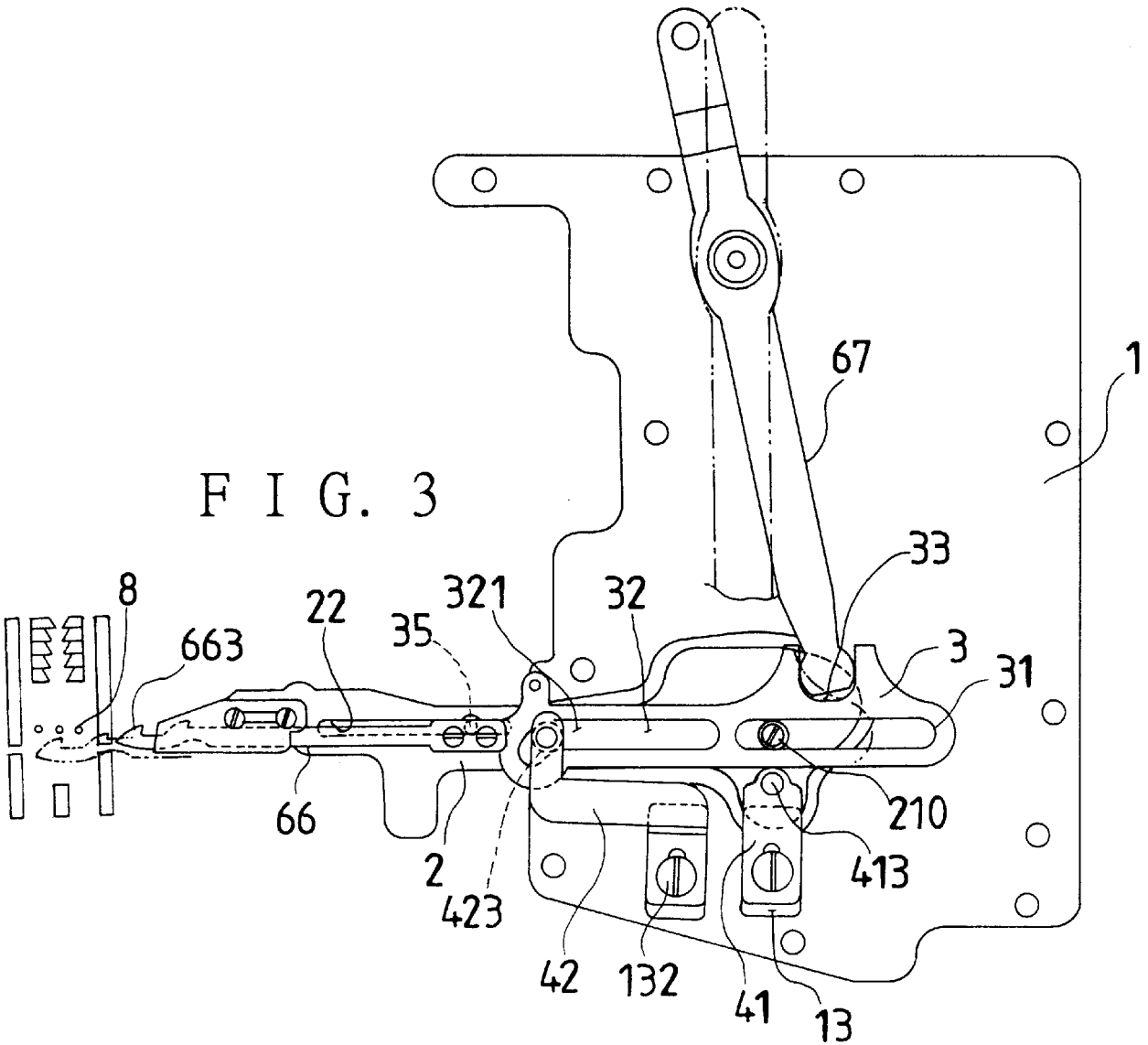
FIG. 3 is another top of the thread cutting device of a sewing machine of the present invention.
Figure 4:
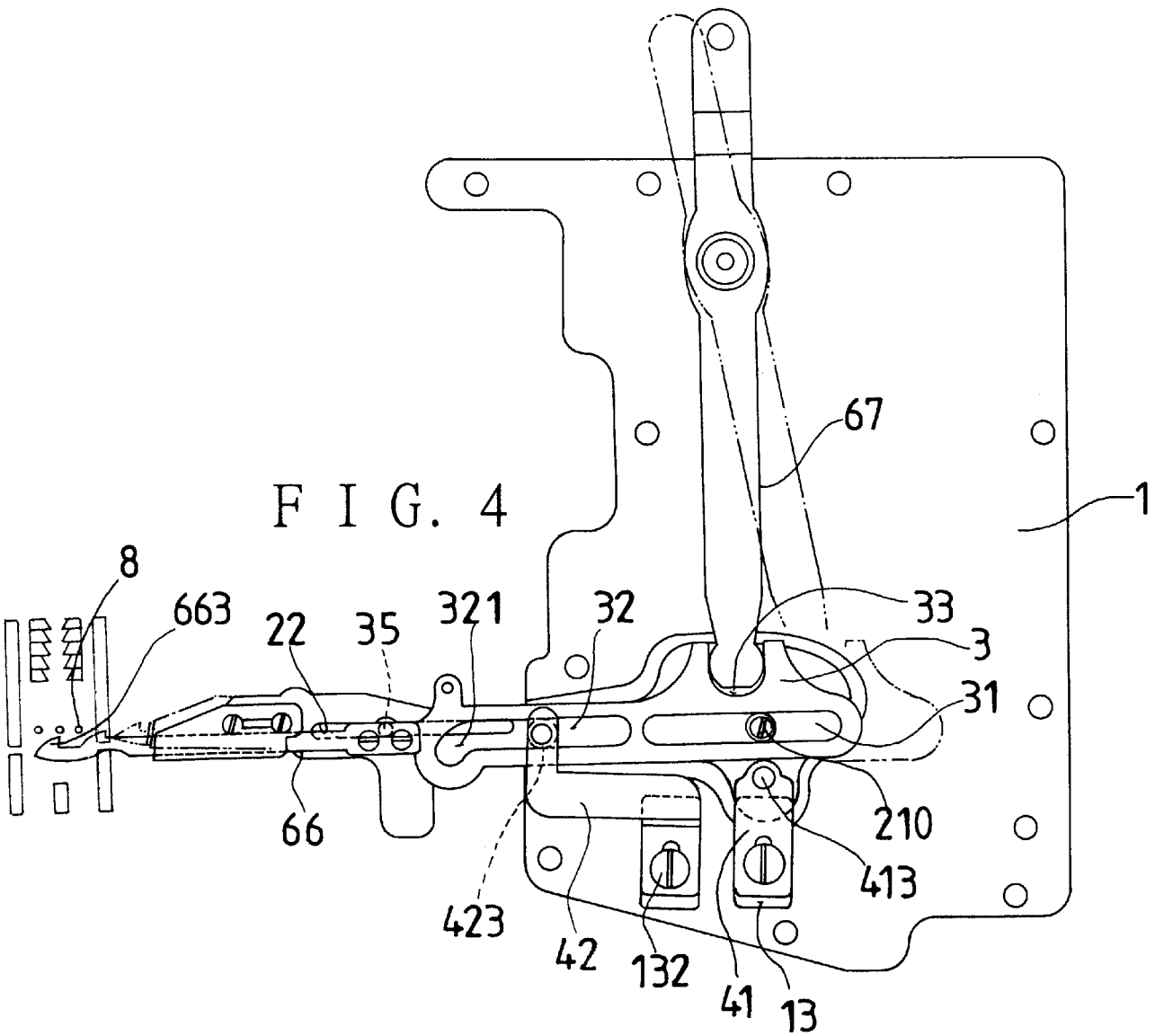
FIG. 4 is a third top view of the thread cutting device of a sewing machine of the present invention.
Figure 5:
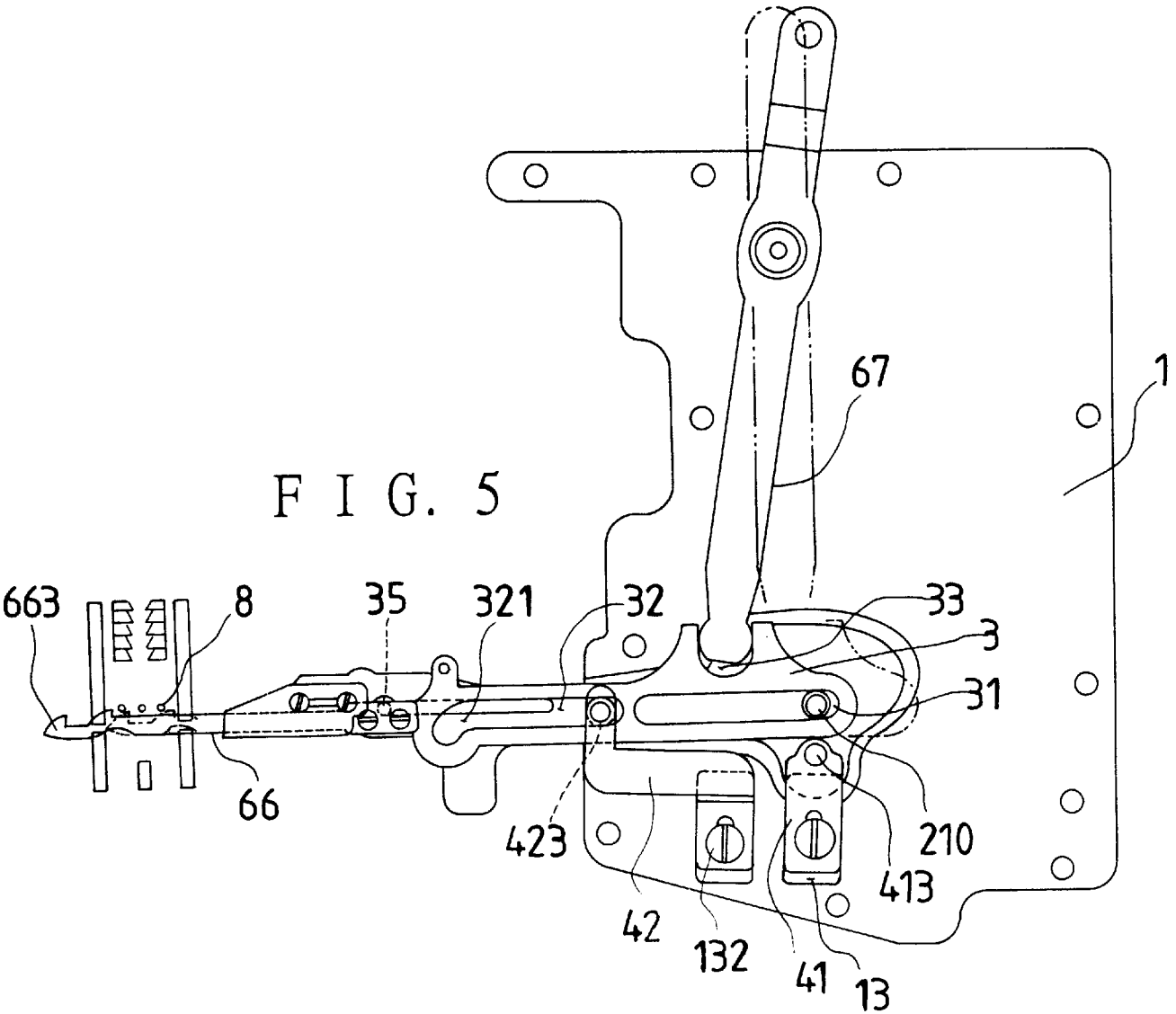
FIG. 5 is a fourth top view of the thread cutting device of a sewing machine of the present invention.
Figure 6:
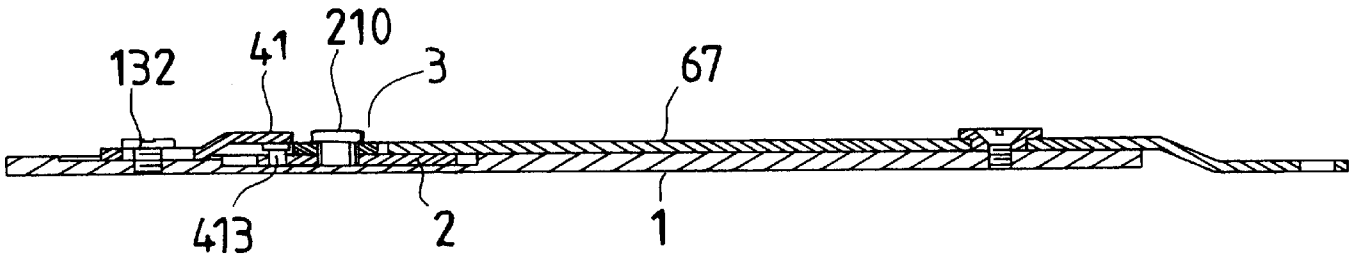
FIG. 6 is a cross-sectional view of the thread cutting device of a sewing machine of the present invention.
Figure 7:
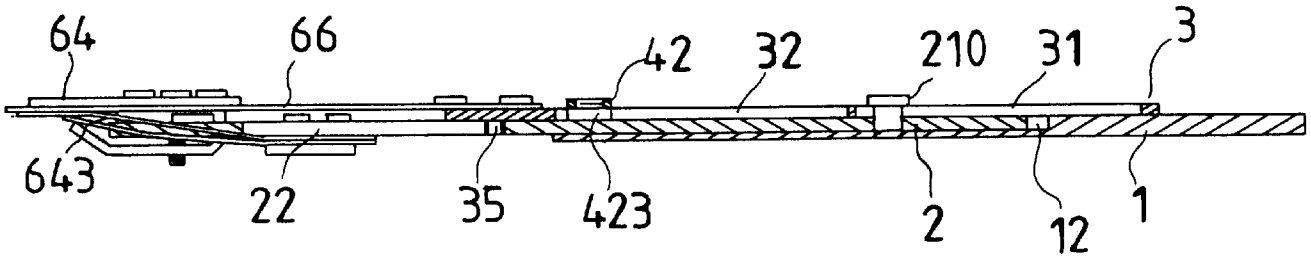
FIG. 7 is another cross-sectional view of the thread cutting device of a sewing machine of the present invention.
Figure 8:
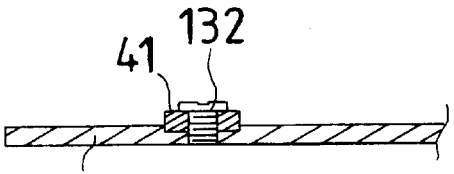
FIG. 8 is a fragmentary cross-sectional view of the thread cutting device of a sewing machine of the present invention.

In using the thread cutting device of a sewing machine, referring to FIGS. 2, 3, 4 and 5, the swing arm 67 is swung to move the hook rod arm 3 back and forth. Firstly, the connecting protrusion 423 of the second adjustable arm 42 is located in the curved end portion 321 of the hook rod arm 3 (FIG. 2); secondly, the hook rod arm 3 moves forwards for the connecting protrusion 423 to separate from the curved end portion 321 such that the hook rod arm 3 and the cutting knife arm 2 are disposed at a position substantially perpendicular to the front side of the fixed plate (FIG. 3). Thirdly, the hook rod arm 3 is moved forwards for the hooks 663, 664 of the hook rod 66 to hook the threads (FIG. 5). Then, the hook rod arm 3 is moved back for the hooks 663, 664 to retreat the threads for the knife 64 to cut off.

To adjust the position of the cutting knife arm 2 such that the fulcrum position, the range of oscillation of the arm 2 and the moving path of the arm 2 are adjusted to optimum ones, the first and the second adjustable arms 41, 42 are first moved in the holding recesses 13, 13' to suitable positions and fixed again.

From the above description, the thread cutting device of a sewing machine of the present invention can be known to have desirable features as follows.

Figure 9:
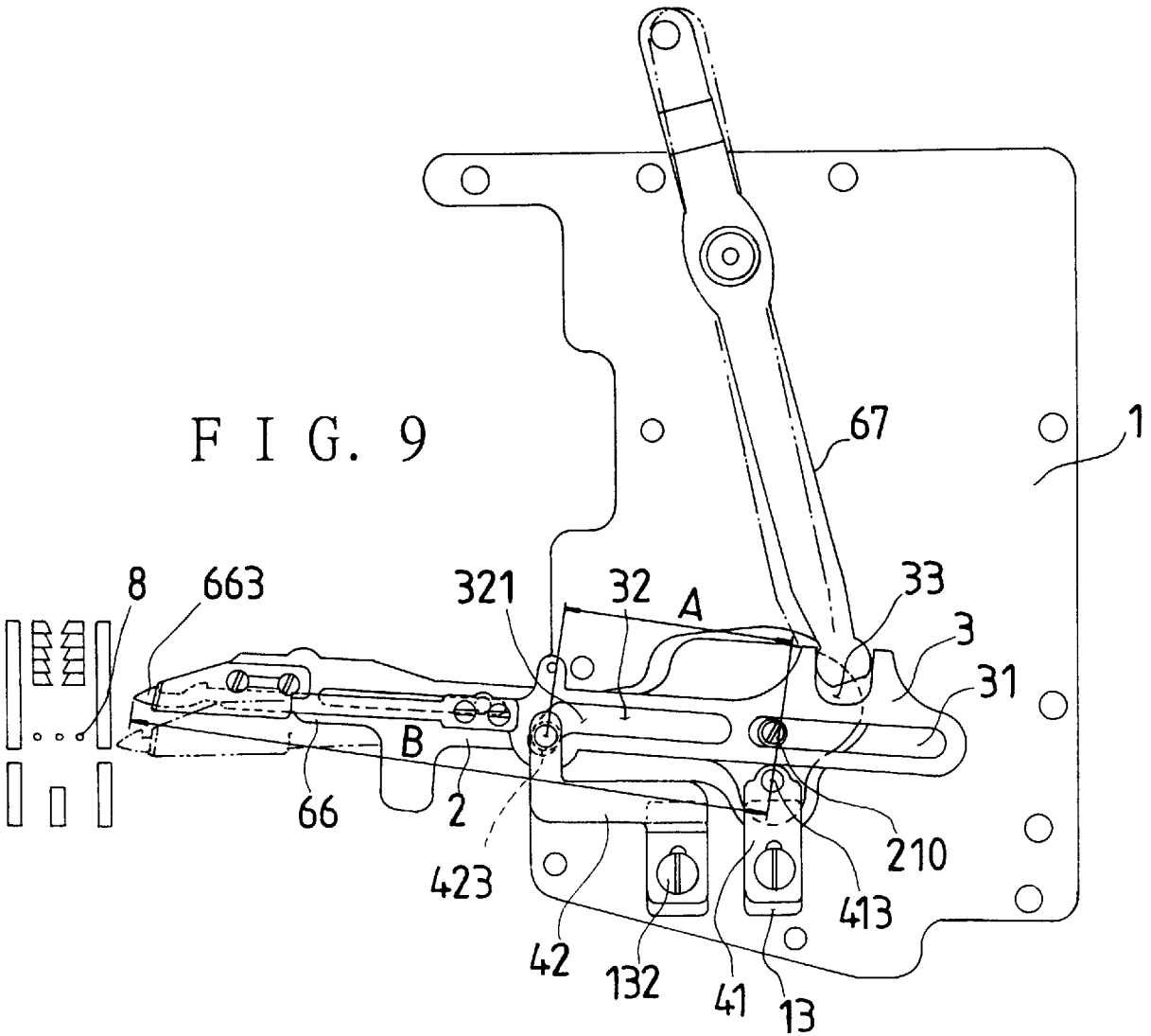
FIG. 9 is a top view of the thread cutting device of a sewing machine of the present invention under operation.
Figure 10:
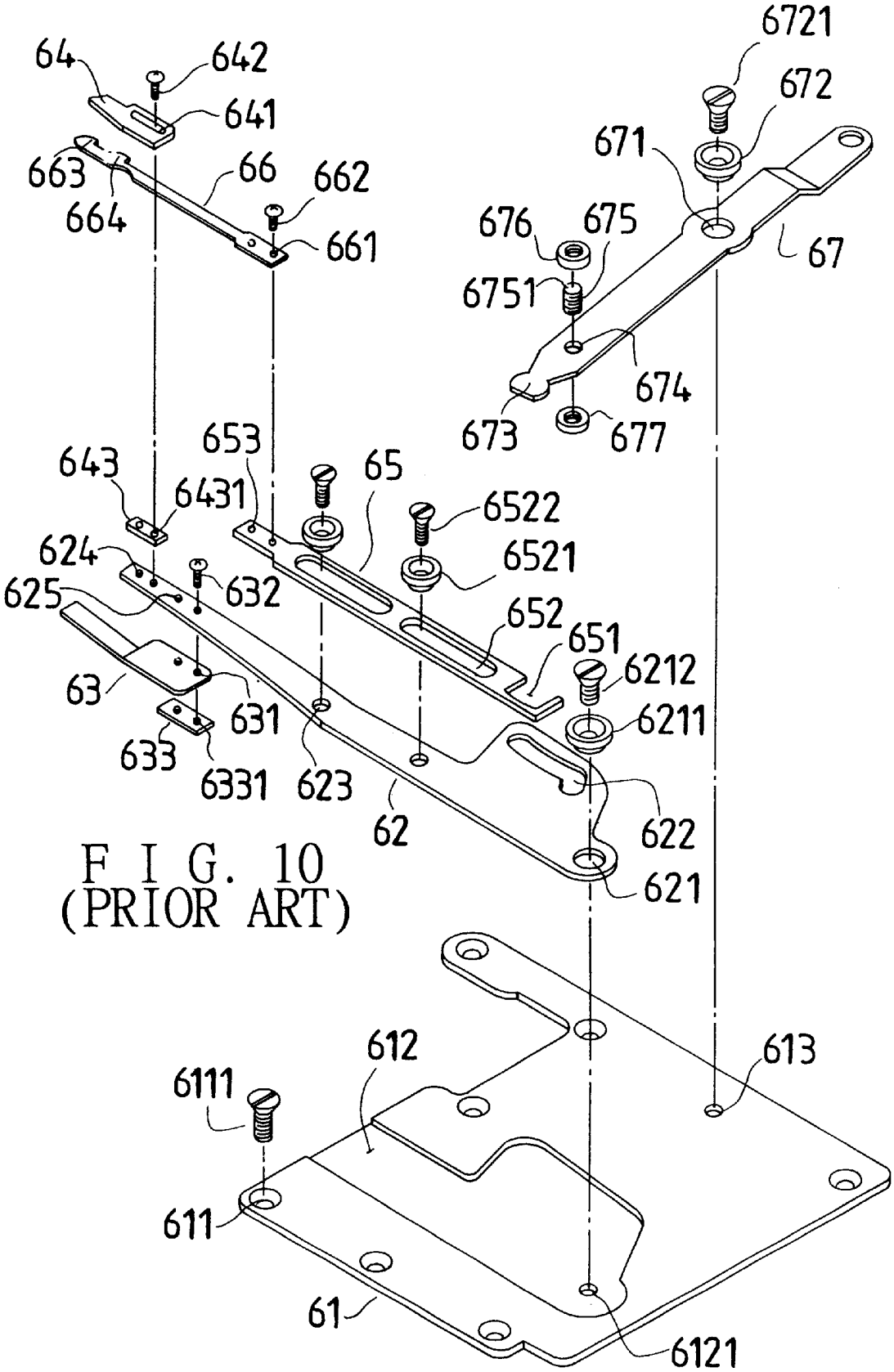
F I G. 10 (PRIOR ART)
FIG. 10 is an exploded perspective view of the conventional thread cutting device in the Background.
Figure 11:
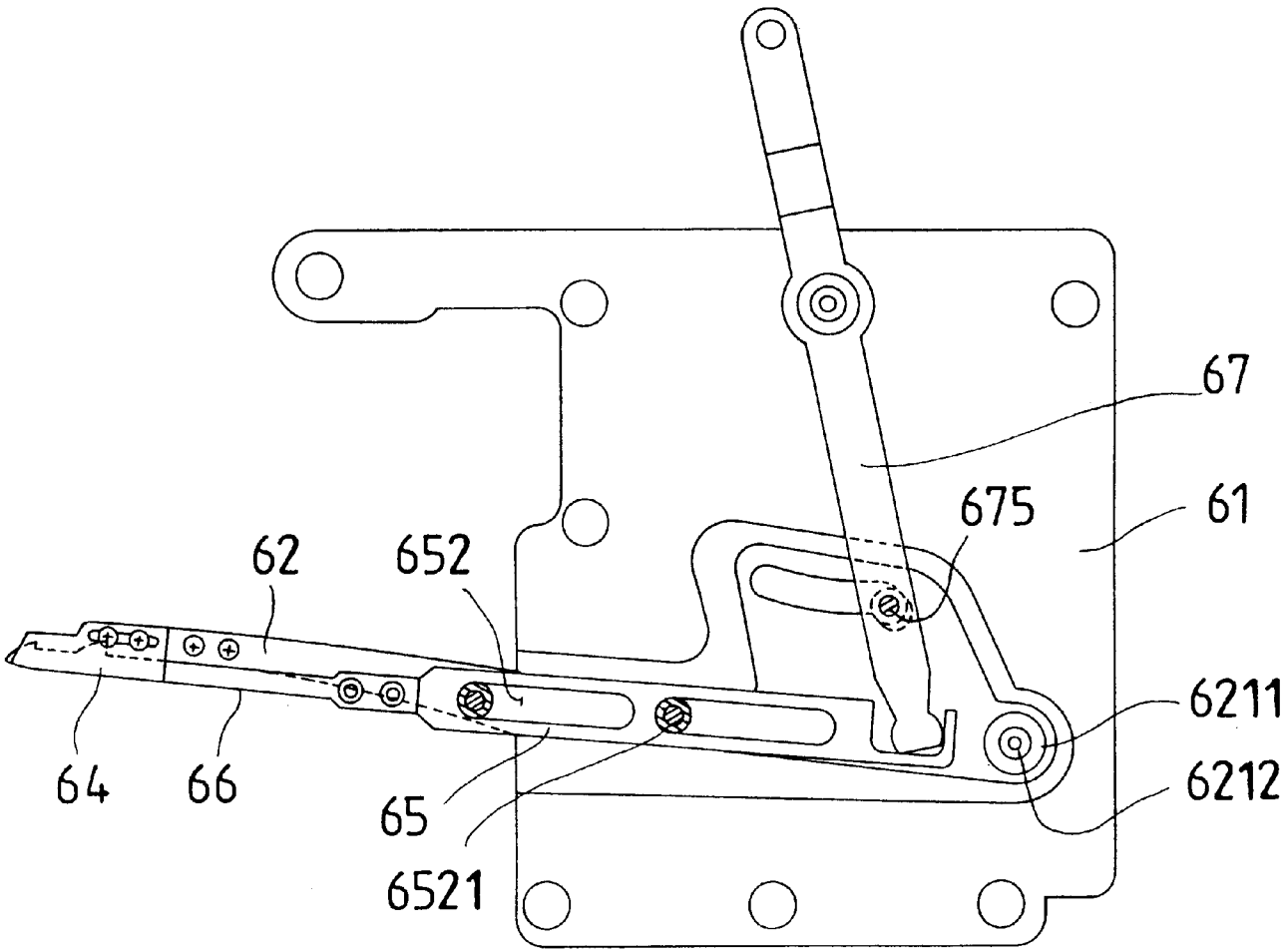
FIG. 11 (PRIOR ART)
FIG. 11 is a top view of the conventional thread cutting device in the Background.
Figure 12:
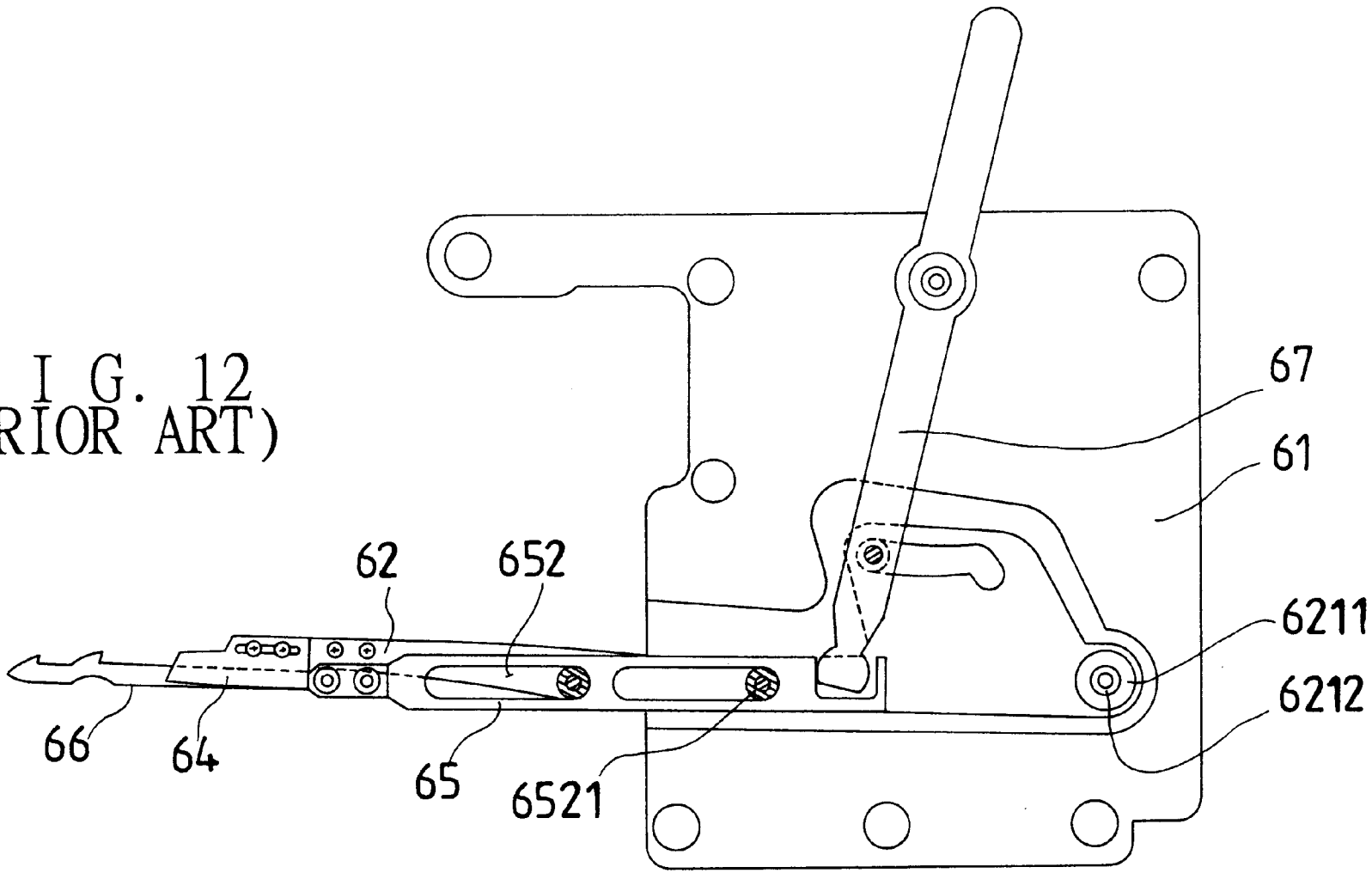
FIG. 12 (PRIOR ART)
FIG. 12 is another top view of the conventional thread cutting device in the Background.
Figure 13:
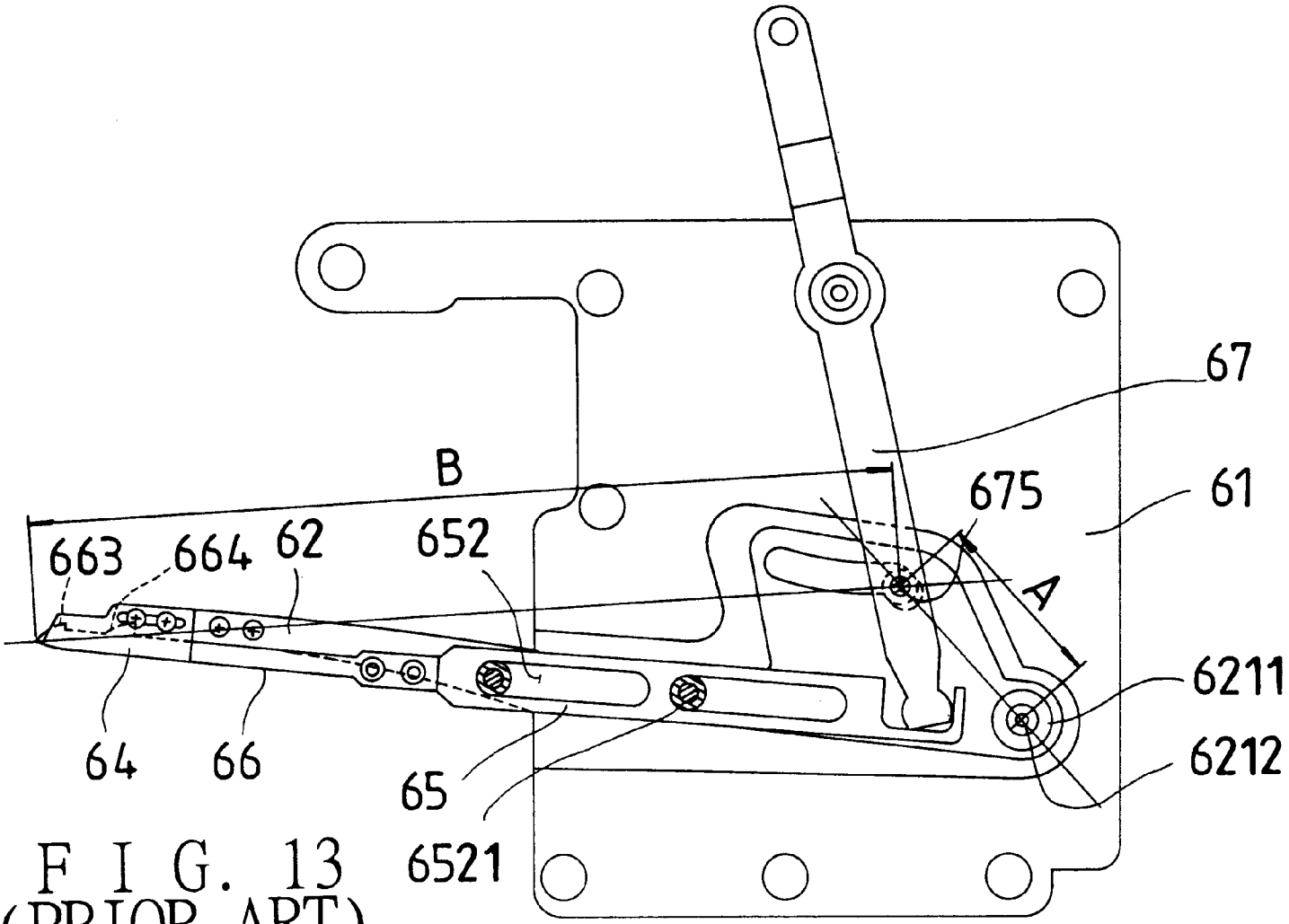
FIG. 13 (PRIOR ART)
FIG. 13 is a top view of the thread cutting device of FIG. 11 under operation.

1. The fulcrum of the cutting knife arm 2, i.e. the connecting protrusion 413 of the adjustable arm 41, is located away from the inner end of the knife arm 2 such that the distance between the fulcrum and the front ends of the knife 64 and the hook rod 66 is smaller than that of the prior art one. Consequently, it takes less power to operate the thread cutting device, and the related parts of the thread cutting device can move more smoothly.
2. Referring to FIG. 9, because the distance between the hook rod arm front end and the protrusion 413, i.e. B, is not much longer than the distance between the curved end portion 321 and the protrusion 413, i.e. A, the swing arm 67 can be swung with less power than the prior art.
3. The position of the fulcrum of the knife arm 2 can be adjusted for an optimum cutting path by means of the adjustable arms 41, 42.

4. The hook rod arm 3, confined by the elongated holes 31, 32 as well as the elongated hole 22 of the knife arm 2, is prevented from shaking in the course of moving back and forth.

What is claimed is:

1. A thread cutting device of a sewing machine, comprising a fixed plate fixed to said sewing machine, an adjustable arm member having a first and a second adjustable arms relocatably fitted on said fixed plate; said adjustable arms each having a connecting protrusion on an outer end thereof, a cutting knife arm having a cutting knife on a front end, said knife arm being pivoted to said connecting protrusion of said first adjustable arm from a hole formed at least a distance from a rear end;

a swing arm pivoted to said fixed plate from an intermediate portion, said swing arm being capable of being swung; said swing arm having a head at an end facing said knife arm;

a hook rod arm having a hook rod at a front end, said hook rod having a plurality of hooks thereon; said hook rod arm having a gap receiving said head of said swing arm therein for permitting said swing arm to move same back and forth; said hook rod arm having first and a second elongated holes receiving a bolt on said knife arm, and said connecting protrusion of said second adjustable arm respectively for confining a moving path thereof when said swing arm is moved back and forth;

said second elongated hole having a curved end portion for permitting said hook rod arm to be adjusted in respect of said moving path when said hook rod arm is moved where said curved end portion separates from said connecting protrusion of said second adjustable arm;

whereby said hooks can hook and retreat threads for said knife to cut off when said swing arm is swung.

2. The thread cutting device of a swing machine as claimed in claim 1, wherein said cutting knife arm has a lengthwise elongated hole on an intermediate portion, and said hook rod arm has a connecting protrusion movably received in said lengthwise elongated hole for confining said moving path of said hook rod arm.

* * * * *